United States Patent [19]

Dickson et al.

[11] 4,020,389

[45] Apr. 26, 1977

[54] ELECTRODE CONSTRUCTION FOR FLEXIBLE ELECTROLUMINESCENT LAMP

[75] Inventors: Arthur D. Dickson, St. Paul; Laurie E. Pruitt, West St. Paul, both of Minn.

[73] Assignee: Minnesota Mining and Manufacturing Company, St. Paul, Minn.

[22] Filed: Apr. 5, 1976

[21] Appl. No.: 673,680

[52] U.S. Cl. ..... 315/246; 29/25.13; 313/503; 313/509; 313/511; 313/512; 313/112; 427/66

[51] Int. Cl.[2] ..... H05B 33/02; H01J 9/02

[58] Field of Search ..... 313/509, 511, 512, 506, 313/112, 503; 427/66; 315/246; 29/25.13

[56] References Cited

UNITED STATES PATENTS

| | | | |
|---|---|---|---|
| 3,104,339 | 9/1963 | Koury | 313/509 X |
| 3,274,419 | 9/1966 | Roth | 313/512 X |
| 3,631,285 | 12/1971 | Laisi et al. | 313/512 X |

*Primary Examiner*—Palmer C. Demeo
*Attorney, Agent, or Firm*—Cruzan Alexander; Donald M. Sell; William B. Barte

[57] ABSTRACT

A flexible electroluminescent lamp comprising a laminate of an opaque metal electrode, a flexible resin body having electroluminescent particles embedded therein and a transparent electrically conductive electrode. The transparent electrode comprises a polymeric substrate having a three layer sandwich thereon, which layers comprise a thin-film metal layer between outer dielectric layers having a relatively high index of refraction. The dielectric layers are formed to provide quarter-wavelength interference filters to result in a high degree of transmittance of the sandwich, while yet enabling the metal layer to be sufficiently thick to result in a low resistivity electrode.

7 Claims, 1 Drawing Figure

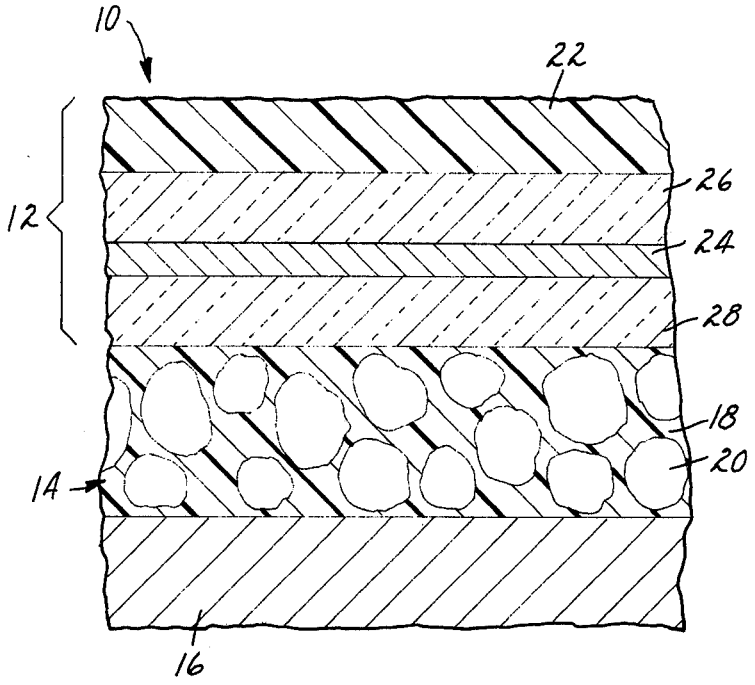
10
22
12
26
24
28
18
20
14
16

ELECTRODE CONSTRUCTION FOR FLEXIBLE ELECTROLUMINESCENT LAMP

BACKGROUND OF THE INVENTION

1. Field of the Invention

This invention relates to improvements in electroluminescent lamps, particularly to an improved flexible electroluminescent lamp having a transparent electrode with improved conductivity and transparency characteristics.

2. Description of the Prior Art

Generally speaking, one type of electroluminescent lamp is made by embedding an electroluminescent phosphor in an organic resinous sheet and sandwiching the sheet between electrodes, one electrode of which is transparent to the light emitted by the phosphor. In the prior art, the transparent light transmitting electrode is generally either a layer of transparent metal oxide such as tin oxide or indium oxide or a deposit of a thin metal layer. Where a thin metal layer is employed as the transparent electrode, a compromise must be made between the light transmissivity and resistivity of the electrode. This compromise has heretofore precluded the formation of an electrode having acceptable levels of transmissivity and resistivity. Accordingly, as disclosed in U.S. Pat. No. 3,274,419 (Roth), typical prior art flexible electroluminescent lamp constructions employ transparent metal coated glass strands as the light transmitting electrode. Such constructions present an improvement over earlier employed grids of metal wires. Both such constructions have the disadvantage in that the grids or strands obscure a portion of the light transmitted from the phosphor layer. Furthermore, the glass strands are fragile, difficult to connect, and inhibit the frequencies at which the lamp may be driven. Furthermore, such constructions tend to establish a nonuniform electric field across the phosphor layer which results in a less efficient device.

Particularly with respect to flexible electroluminescent lamp constructions, considerable work has been directed to developing evaporated transparent metallic conductors. Such attempts, however, have not resulted in a viable lamp in that the conductivity and required transparency have not heretofore been obtainable in a single construction. For example, continuous electrode structures of stannic or indium oxide deposited on glass using a high temperature process have typically produced values of transparency of approximately 85% while having a resistivity on the order of about 100 ohms/square. Such electrodes may be suitable for rigid panels and flexible, fragile glass fiber paper substrates but, because of the high temperature deposition requirements, are unsuitable for use with flexible polymeric film constructions. Where evaporated electrodes such as gold have been tried in the past, if the thickness of the gold film is increased sufficiently to obtain a resistivity sufficiently less than 100 ohms/square, then the transmissivity typically decreases to approximately 50%.

SUMMARY OF THE INVENTION

The present invention is directed to a flexible electroluminescent lamp comprising a light transmitting flexible resin body member having opposing faces and a finely divided electroluminescent phosphor embedded therein and electrically conducting electrode layers, one of which is at least substantially transparent, affixed to the opposing faces of the body member. In the particular construction of the present invention, the substantially transparent electrode layer comprises a transparent polymeric substrate having on a surface thereof a three layer sandwich of thin-film of a metal selected from the group including gold, silver and copper, between layers of a thin-film dielectric material generally exhibiting an index of refraction in excess of two. The lamp is assembled such that the outer dielectric layer is adjacent the body member. The metal layer is formed to have a resistivity of less than 30 ohms/-square and a thickness in the range between 70 and 180° A. The layers of the thin-film dielectric material are selected to have a thickness in the range between 400 and 600 A. These combined properties result in the transparent electrode layer having a transmissivity to radiation to be emitted by the phosphor of not less than 70% and a reflectivity to visible radiation of less than 15%.

In a preferred embodiment, the high index dielectric materials are selected from a group of materials generally exhibiting a high index of refraction, i.e., greater than two, consisting of sulfides of zinc, cadmium, mercury, tin, lead, antimony and bismuth; chlorides, bromides and iodides of copper, silver and lead; and oxides of titamium and bismuth. In a particularly preferred embodiment, the three layer sandwich of the transparent electrode layer comprises a thin-film of silver between thin-films of zinc sulfide, in which the resistivity of the silver film is not greater than 10 ohms/square and the transmissivity of the sandwich is greater than 80% to light of 5500 A. Additional interferometric layers may also be provided to further reduce the electrical resistivity while simultaneously maintaining the requisite transmissivity.

Such a flexible electroluminescent lamp is preferably constructed by prefabricating the flexible resin body member having the finely divided electroluminescent phosphor embedded therein together with a nontransparent electrically conducting electrode layer, and similarly, separately fabricating the substantially transparent electrode layer. Accordingly, the resin body member is formed by coating a dispersion of a selected phosphor resin in a suitable binder system onto a substrate such as an electrically conductive substrate (Ex.: aluminum foil), which substrate ultimately forms one of the electrodes of the lamp. Such a construction is subsequently passed by a heat source to evaporate the solvent and harden the resin coating. The transparent electrode layer is also prefabricated by a subsequent vapor depositions of the three layers onto a flexible transparent substrate such as a polymeric sheet. The two prefabricated members are then assembled, with the final dielectric layer placed in contact with the exposed surface of the resin body member. The assembled members are adhered together such as by passing the assembled members between a heated nip roller assembly.

Such a construction is particularly desired in that it facilitates by continuous production of large sheets of the assembled prefabricated members, which may thereafter be cut to a variety of sizes and shapes, contacted and, if desirable, further processed to hermetically protect the phosphor layer.

BRIEF DESCRIPTION OF THE DRAWING

The drawing shows a cross sectional view of a preferred embodiment of the electroluminescent lamp of the present invention.

DESCRIPTION OF THE PREFERRED EMBODIMENTS

As shown in the cross sectional view of the drawing, the electroluminescent lamp 10 of the present invention includes three basic members, a layer of electroluminescent material 14, sandwiched between two electrode layers 12 and 16 respectively. The construction of the electroluminescent layer 14 and the bottom electrode layer 16 arc of conventional construction. As is well known to those skilled in the art, such layers are typically formed from a dispersion of electroluminescent particles 20 in a polymeric binder 18, which dispersion is coated onto an electrically conductive sheet such as aluminum foil, aluminum or metal vapor coated onto a polymeric sheet, or the like. In a preferred embodiment of the present invention, such a construction was formed from 30 micron average diameter electroluminescent particles of electroluminescent quality Cu doped ZnS particles, commercially available from Sylvania Electric Products, Inc. in an acrylic-solvent system. This dispersion was then knife-coated as a wet thickness of approximately 150 micron onto a 50 micron thick aluminum foil substrate. The wet coating ws then passed adjacent a heat source to evaporate the solvent from the dispersion thereby forming a dried coating approximately 65 microns thick. Such coatings arc well known to those skilled in the art, and thus a wide range of variations in the construction of the electrode 16 as well as in the type of phosphor particles, binders, solvents, coating systems and the like will readily be construed to be within the scope of the present invention.

In contrast, the transparent conductive electrode 12 of the present invention is subject to more critical constraints. In the present invention, the electrode 12 has a resistivity less than 30 ohms/square while at the same time exhibits a transmissivity in excess of 70% to radiation produced upon excitation of the phosphor. In a preferred embodiment, the transparent electrode 12 is formed of a transparent polymeric substrate 22, such as polyethylene terephthalate or the like. Such substrates are selected to be optically clear and to have a relatively high degree of optical transparency. To facilitate handling during processing, such a substrate is desirably selected to be relatively thick, thereby minimizing propensities for the substrate to wrinkle or become twisted during processing operations. In one embodiment, a 100 micron thick polyethylene terethphalate substrate is preferred. Such a substrate is provided with a sandwich of a metal film 24 between two high index of refraction dielectric films 26 and 28 by suitable evaporation processes.

In a typical such process, a first dielectric layer 26 is evaporated onto the substrate 22 in an operation in which the substrate is placed in an evacuable chamber, the pressure is reduced to pressures consistent with typical vapor coating processes, such as approximately $10^{-5}$ Torr, and a film of the selected dielectric is deposited thereon. In one particularly preferred embodiment, a layer of zinc sulfide approximately 510 A. thick was thus provided. Such a material may be evaporated from a single boat containing a charge of zinc sulfide powder. The thickness of the deposit may be continuously monitored according to conventional techniques such as with a crystal-type deposition monitor apparatus or suitable electrical and optical techniques.

Following the deposition of the first dielectric layer 26, a metal layer 24 is evaporated upon the dielectric layer 26. While the metal may be any of the highly conductive metals such as gold, silver and copper, a particularly preferred metal is silver, such that a highly conductive yet transparent film is obtained at a relatively low cost. In a particularly preferred embodiment, a 120 A. thick layer of silver was deposited. Depending upon the choice of metal and the required degree of transparency and conductivity, similar layers of metals may be deposited in the range of 60 to 300 A. thicknesses; however, a thickness in the range of 120 to 150 A. have been found to be particularly desirable.

Upon the formation of the metal layer 24, the second dielectric layer 28 is deposited onto the metal layer 24 in the same manner as that used during the formation of the first layer 26. The dielectric layers 26 and 28 form essentially quarter-wavelength interference filters in which the thickness is effectively equal to one quarter of the wavelength of visible radiation whose transmission is desirably maximized. In the particularly preferred embodiment, both the dielectric layers 26 and 28 were formed of a 510 A. thick layer of zinc sulfide. The thickness is preferably maintained between limits of 400 to 600 A., those being the effective thickness of a quarter-wavelength coating for visible radiation.

As is well known to those skilled in the art, such dielectric layer may be selected from a large variety of materials. Typically, oxides of titanium, tin and bismuth; sulfides of zinc, cadmium and antimony; and cuprous iodide are especially preferred due to the ease in evaporation and relatively low cost. Bismuth oxide is particularly desired in that it is more stable at elevated temperatures than many of the dielectric materials. Various of the other dielectric materials recited in the list above may similarly be preferred depending upon the selection of the metals to be used therewith, the wavelength of the radiation to be produced by the phosphor and conditions under which the resultant lamp is intended to be utilized. Likewise, different dielectrics of varying thickness may be used in each of the layers.

Upon formation of the two prefabricated members, these members are assembled by placing the outer dielectric layer 28 into contact with the phosphor layer 14 and passing the assembled members between a heated nip roller. Preferably, the roller adjacent the polymeric surface 22 is steel and is heated to approximately 300° F, while the roller adjacent the aluminum base member is rubber, maintained at room temperature. The pressing causes the aluminum foil and phosphor layer to conform into intimate contact with the outer dielectric layer 28 while being heat-fused to the dielectric layer to form an integrated homogeneous construction.

Contacts may then be fitted to the aluminum electrode layer 16 and to the metal thin-film layer 24 in a conventional manner such that the lamp may be energized as appropriate.

In a typical construction wherein a 125 A. thick layer of silver was sandwiched between 510 A. thick layers of zinc sulfide on a polyester base, the transparent electrode exhibited a conductivity of approximately 5 ohms/square, a transmissivity to radiation of 5500 A. of approximately 85%, and a reflectivity to visible radiation of less than 5%. Such an electrode was bonded to a 65 micron layer of copper doped zinc sulfide luminescent phosphor in an acrylic binder on a 50 micron aluminum foil base electrode and suitably contacted to form an electroluminescent lamp. The resultant lamp was tested and found to exceed the performance of typical lamps formed by prior art processes.

The lamps of the present invention are particularly suited to operation at relatively high frequencies. In one embodiment, a system including the lamp and a source of high frequency power is desirably provided. One such system includes a source of 1000 Hz, 175 V peak-to-peak electrical power. When a lamp such as described above was energized with such a power source, it was determined that the lamp exhibited a lifetime in excess of 1,000 hours to half-brightness. The intensity of the light produced was found to exhibit a greater than 50% increase in intensity over similar evaporated electrode constructions formed of the same metals, but without the dielectric layers. Unlike prior art lamps utilizing a metal coated glass paper or wire mesh construction wherein such high frequency operation produces a very nonuniform emission of light across the surface of the device, the lamps of the present invention produce substantially uniform intensity over the entire device when similarly operated at high frequencies.

In additional embodiments, the transparent electrode was formed of thin-films of gold and copper respectively between dielectric layers of zinc sulfide in a manner analogous to that discussed hereinabove. In these embodiments, the electrode utilizing a gold electrode was found to exhibit resistivities ranging between 8–14 ohms/square, while having a transparency and reflectivity in the same range as that of the silver containing electrode. Similarly, the copper containing electrode exhibited resistivities in the range of 14–20 ohsm/-square and a transparency in the range between 75 and 82%.

Having thus described the present invention, what is claimed is:

1. A flexible electroluminescent lamp comprising a light transmitting flexible resin body member having opposing faces and a finely divided electroluminescent phosphor embedded therein and electrically conducting electrode layers, one of which is at least substantially transparent, affixed to the opposing faces of the body member, the improvement wherein said substantially transparent electrode layer comprises a transparent polymeric substrate having on a surface thereof a three layer sandwich of a layer of a thin-film of a metal selected from the group including gold, silver, and copper between layers of thin-film dielectric materials generally exhibiting an index of refraction in excess of two, the outer dielectric layer being positioned adjacent the body member, wherein the metal layer has resistivity of less than 30 ohms/square and a thickness in the range between 70 and 180 A, and each of the layers of the thin-film dielectric material have a thickness in the range between 400 and 600 A., wherein the transmissivity of said transparent electrode layer to radiation to be emitted by the phosphor is not less than 70% and wherein the reflectance of said transparent electrode layer to visible radiation is less than 15%, whereby the transparent electrode layer enables the light source to operate at frequencies in excess of 400 Hz while maintaining substantially uniform brightness over the entire transparent electrode layer.

2. A flexible electroluminescent lamp according to claim 1, wherein the dielectric materials are selected from the group consisting of sulfides of zinc, cadmium, mercury, tin, lead, antimony and bismuth; chlorides, bromides and iodides of copper, silver and lead; and oxides of titanium and bismuth.

3. A flexible electroluminescent lamp according to claim 1, wherein the three layer sandwich of the transparent electrode layer comprises a thin-film of silver between thin-films of zinc sulfide, the resistivity of the silver film being less than approximately 10 ohms/-square and the transmissivity of the sandwich being greater than approximately 80% to light of 5500 A.

4. A lamp according to claim 1, further comprising a substantially moisture impregnable sheet hermetically enclosing the flexible resin body member.

5. A system for producing light by electroluminescence including a flexible electroluminescent lamp which comprises a light transmitting flexible resin body member having opposing faces and a finely divided electroluminescent phosphor embedded therein and electrically conducting electrode layers, one of which is at least substantially transparent, affixed to the opposing faces of the body member, and means for applying an electrical potential to said electrode layers, which potential periodically alternates at a frequency in excess of 400 Hz, the improvement wherein said substantially transparent electrode layer comprises a transparent polymeric substrate having on a surface thereof a three layer sandwich of a layer of a thin-film of a metal selected from the group including gold, silver and copper between layers of thin-film dielectric materials generally exhibiting an index of refraction in excess of two, the outer dielectric layer being positioned adjacent the body member, wherein the metal layer has resistivity of less than 30 ohms/-square and a thickness in the range between 70 and 180 A., and each of the layers of the thin-film dielectric material have a thickness in the range between 400 and 600 A., wherein the transmissivity of said transparent electrode layer to radiation to be emitted by the phosphor is not less than 70% and wherein the reflectance of said transparent electrode layer to visible radiation is less than 15%, whereby the low resistivity of the transparent electrode layer enables the light source to efficiently emit light when energized by said alternating potential and to exhibit substantially uniform brightness over the entire transparent electrode layer.

6. A method of making a flexible electroluminescent lamp comprising the steps of forming a sheet having a coating of electroluminescent particles embedded in an organic binder on a flexible electrically conductive substrate, forming a substantially transparent electrically conductive sheet according to the sub-steps of providing a transparent polymeric sheet as a substrate, forming a first thin-film dielectric layer on a surface of the polymeric sheet, said first dielectric layer generally exhibiting an index of refraction in excess of two and having a thickness in the range between 400 and 600 A., forming a layer of a thin-film of a metal selected from the group consisting of gold, silver and copper on the exposed surface of the first dielectric layer, said metal layer having a thickness in the range between 70 and 180 A. and a resistivity of less than 30 ohms/square, and forming a second thin-film dielectric layer on the exposed surface of the metal layer, said second dielectric layer generally exhibiting an index of refraction in excess of two and having a thickness in the range between 400 and 600 A., bonding the transparent conductive sheet to the sheet having a coating of electroluminescent particles by positioning the sheets such that the exposed surface of the electroluminescent particle coating and heat-fusing the two sheets together to form a homogeneous integral construction, and securing electrical contacts to the electrically conductive substrate and to the metal layer.

7. A method according to claim 6, further comprising the step of hermetically sealing said integral construction within a substantially moisture impregnable enclosure.

* * * * *

UNITED STATES PATENT OFFICE

CERTIFICATE OF CORRECTION

Patent No. 4,020,389 Dated April 26, 1977

Inventor(s) Arthur D. Dickson et al.

It is certified that error appears in the above-identified patent and that said Letters Patent are hereby corrected as shown below:

Column 2, line 47, delete "resin".

Column 5, line 38, change "ohsm" to -- ohms --.

Column 8, line 4, after "coating" insert -- is in contact with the second thin-film dielectric layer --.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*